United States Patent [19]

Gilbert et al.

[11] 4,269,687

[45] May 26, 1981

[54] ELECTRODE SUSPENSION BARS

[75] Inventors: John R. B. Gilbert, Sutton Coldfield; Peter H. Baldwin, Aldridge, both of England

[73] Assignee: IMI Kynoch Limited, Birmingham, England

[21] Appl. No.: 114,597

[22] Filed: Jan. 23, 1980

[30] Foreign Application Priority Data

Jan. 23, 1979 [GB] United Kingdom ..... 02422/79

[51] Int. Cl.[3] ..... C25C 7/02

[52] U.S. Cl. ..... 204/242; 204/288; 204/289; 204/292

[58] Field of Search ..... 204/242, 286, 288, 289, 204/292

[56] References Cited

U.S. PATENT DOCUMENTS

| | | | |
|---|---|---|---|
| 2,666,029 | 1/1954 | De Quasie et al. | 204/286 |
| 2,723,230 | 11/1955 | Godsey, Jr. | 204/286 |
| 2,848,411 | 8/1958 | Hartzell | 204/286 X |
| 3,857,774 | 12/1974 | Morton et al. | 204/288 X |
| 4,014,763 | 3/1977 | Lowe | 204/286 X |

*Primary Examiner*—Delbert E. Gantz
*Assistant Examiner*—D. R. Valentine
*Attorney, Agent, or Firm*—Cushman, Darby & Cushman

[57] ABSTRACT

A hanger bar for use in electrolytic copper or zinc production cells comprising a steel reinforced bar with extra reinforcement at the contact points, the extra reinforcement being provided by a block of copper or a copper alloy having greater strength than the remainder of the bar.

13 Claims, 3 Drawing Figures

ELECTRODE SUSPENSION BARS

BACKGROUND OF THE INVENTION

This invention relates to electrode suspension bars, particularly, but not exclusively, to suspension bars for lead anodes and for copper cathodes used in electrolytic copper production, and for lead anodes used in electrolytic zinc production.

Conventionally, lead anodes for use in metal winning are cast around hard-drawn copper suspension bars which are supported at their extremities and contacted electrically by a current supplying busbar. Suspension bars made entirely of hard-drawn copper, and of sufficient cross-sectional area to carry the required electric current, are usually strong enough to carry the full weight of the anode. During the process, however, the copper becomes annealed, especially at the end of the suspension bar where the current is introduced. Bending of the bar during normal use may result, and more damage may be caused by mishandling when, for example, anodes are dropped or lowered too rapidly into a cell.

Similarly drawn copper bars, sometimes tubular, are used for suspending looped copper starter sheets in copper winning and refining and these are softened and bent in service in similar manner to the anode bars.

To provide extra strength, and for reasons of economy also, steel cored suspension bars are now being used. To avoid corrosion the steel core in such bars must be entirely enveloped by copper. Adequate current carrying capacity is ensured if the enveloping layer of copper is from 3 to 5 mm thick.

Occasionally, suspension bars made entirely of copper have notches at their ends to co-operate with a raised feature on the busbar. In this way location upon the busbar is facilitated, and electrical contact between the busbar and the suspension bar is improved. This practice has not hitherto been possible with steel cored suspension bars, however, because notching after enveloping with copper would expose some of the steel, and the application of a copper envelope to a steel bar already carrying a notch is not feasible.

SUMMARY OF THE INVENTION

According to the invention we provide a suspension bar for an electrode sheet including a steel core with a surrounding layer of copper, the bar including, at the point adapted for contact with an electric current supply, a block of copper or of a copper alloy, said block being metallurgically bonded to the layer of copper, the block having on one side a notch transverse to the longitudinal axis of the bar, the steel core extending in a longitudinal direction beyond a part at least of the block on the side of the block opposite the notch.

Preferably the core extends in a longitudinal direction beyond the tip of the notch.

The suspension bar of the invention may have a cross-section of any desired shape, but is preferably of rectangular, or even square, section. In general the suspension bar will be about 1 to 2 m in length and have a cross-sectional area of about 500 to 1,000 $mm^2$. The layer of copper surrounding the the steel core will conveniently be about 3 to 5 mm thick.

Copper alloys of which the metallurgically bonded block may be formed include for example:

copper-cadmium alloys containing, for example, 0.8% by weight of cadmium;

copper-chromium alloys containing, for example, 0.6% by weight of chromium.

Such alloys are advantageously used for electrical contacts being only a little less conductive than cooper, and more durable to the heat, arcing and abrasion at the contact point.

The metallurgical bond may be a welded or brazed bond.

In a first embodiment of the invention the block of copper or alloy is included in the suspension bar as an insertion. Such a suspension bar may be made by cutting into a copper covered steel cored bar a transverse recess to fit the block, inserting the block and bonding (for example welding) the inserted block to the adjacent copper along the lines of contact.

In a second embodiment of the invention an L-shaped block of copper or alloy forms an end portion of the suspension bar, being accommodated onto a conversely shaped end of a copper covered steel cored bar and bonded (for example welded) to the adjacent copper along the lines of contact. In this way the block functions as an end piece for the bar as well as an electrical contact point.

The notch may be of triangular, square, rounded, or any other desired section.

The suspension bars of the invention are particularly useful for the support of lead anodes, and may be shaped to povide a central region parallel to but spaced from the two end regions.

The present invention also provides a lead anode suspended on a steel cored hanger bar as herein described.

The present invention further provides an electrolytic cell particularly an electrowinning cell incorporating anodes having hanger bars as herein described.

BRIEF DESCRIPTION OF THE DRAWINGS

Specific examples of the invention will now be described with reference to the accompanying drawings, in which.

DESCRIPTION OF THE PREFERRED EMBODIMENTS

Figure 1:
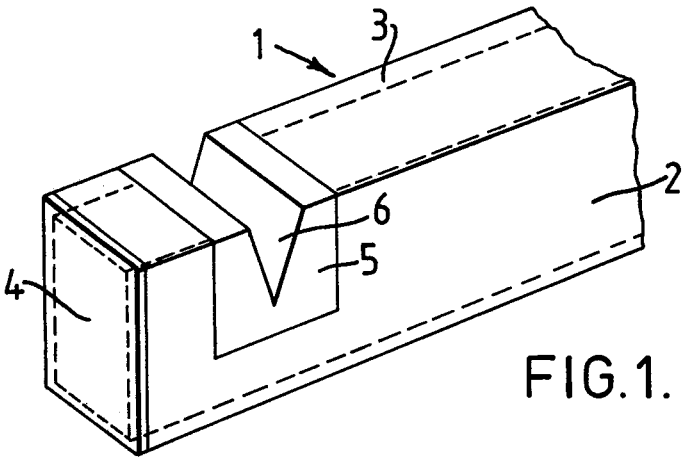
FIG. 1 is a perspective drawing of a first example.

FIG. 1 shows one end of a suspension bar indicated generally by the numeral 1, having a rectangular sectioned steel core 2 shown by the dotted lines, surrounded by an outer layer of copper 3. An end plate 4 of copper is welded to the copper layer 3 so that no steel is exposed at the end of the bar. A block 5 of copper or of one of the aforementioned alloys, having a triangular notch 6 extending across its width, fits exactly into a machined recess close to the end of the bar and is secured in position by welding along the lines of contact with the adjacent copper layer.

The manufacture of such a suspension bar requires two separate welding operations, one to secure the end plate 4 and one to secure the block 5.

Figure 2:
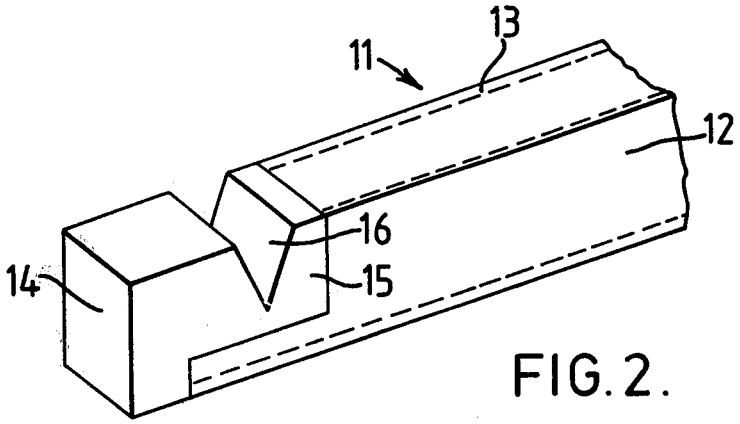
FIG. 2 is a perspective drawing of a second example.

FIG. 2 shows one end of a suspension bar indicated generally as 11. Over most of its length the bar has a steel core 12, indicated by dotted lines, and a surrounding layer of copper 13. The end of the bar is formed by a copper block rectangular in section at its outer end 14, and formed with a portion 15 of smaller rectangular section so that it is L-shaped in side view. A triangular notch 16 extends across the width of the block. The main length of the bar is machined to provide a step with a tread to accommodate the L-shaped end block and form therewith a bar with uninterrupted smooth surfaces, except for the notch. Welding of the block to the copper surround along all lines of contact secures the block to the main length of the bar.

The manufacture of such a suspension bar requires only one welding operation as the block performs two functions, an end cap and a suspension point, and the total amount of welding needed can be less than that needed to make the suspension bar shown in FIG. 1.

Figure 3:
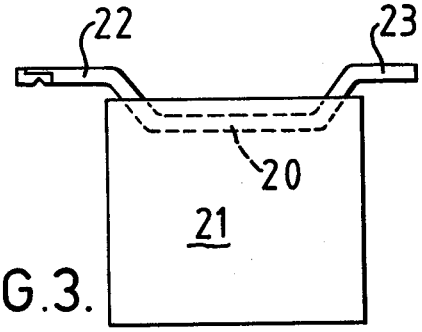
FIG. 3 is a front view of a lead anode in accordance with the invention.

A lead anode utilizing a hanger bar is shown in FIG. 3. It can be seen that the hanger bar is bent in the conventional fashion, with the central region 20, which is embedded in the lead, being displaced from but parallel to the end portions 22 and 23. The electrode is then usable in an elecrolytic cell.

We claim:

1. A suspension bar for an electrode sheet including a steel core with a surrounding layer of copper, the bar including, at the point adapted for contact with an electric current supply, a block of copper or of a copper alloy, said block being metallurgically bonded to the layer of copper, the block having on one side a notch transverse to the longitudinal axis of the bar, the steel core extending in a longitudinal direction beyond a part at least of the block on the side of the block opposite the notch.

2. A suspension bar as claimed in claim 1 in which the core extends in a longitudinal direction beyond the tip of the notch.

3. A suspension bar as claimed in claim 2 in which the steel core extends completely beyond the block.

4. A suspension bar as claimed in claim 1 in which the steel core extends partially beyond the block.

5. A suspension bar as claimed in claim 2 in which the block is included in the suspension bar as an insertion.

6. A suspension bar as claimed in claim 5 in which the bar has a machined transverse recess into which the insert is located and welded.

7. A suspension bar as claimed in claim 4 in which the block is generally L-shaped and forms an end portion of the suspension bar, the suspension bar having a step, the tread portion of which supports the block on the side of the block opposite the notch, the block forming a combined end cap and support point.

8. A suspension bar as claimed in any one of claims 1 to 7 in which the block is formed of a copper alloy chosen from the group copper plus 0.8% cadmium and copper plus 0.6% chromium.

9. A suspension bar as claimed in claim 1 in which the copper layer is 3 to 5 mm thick.

10. A suspension bar as claimed in claim 1 in which the length of the bar is in the region 1 to 2 m.

11. A suspension bar as claimed in claim 1 in which the metallurgical bond is formed by a weld or a braze.

12. A lead anode suspended on a steel cored suspension bar as claimed in claim 1.

13. An electrolytic cell incorporating electrodes suspended on a steel cored suspension bar as claimed inn claim 1.

* * * * *